United States Patent [19]

Bernstein et al.

[11] Patent Number: 4,611,652

[45] Date of Patent: Sep. 16, 1986

[54] METHOD OF PREVENTING CORROSION IN BOILER-PLANT EQUIPMENT

[76] Inventors: Ragnar L. H. Bernstein, Solbacksvagen 67, Fagersta, Sweden, S-773 00; Lars A. Tiberg, Postlada 4201, Vad, Soderbarke, Sweden, S-770 20

[21] Appl. No.: 658,058

[22] Filed: Oct. 4, 1984

Related U.S. Application Data

[63] Continuation of Ser. No. 362,506, Mar. 26, 1982, abandoned, which is a continuation-in-part of Ser. No. 348,828, Feb. 16, 1982, abandoned, which is a continuation of Ser. No. 232,661, Feb. 9, 1981, abandoned.

[30] Foreign Application Priority Data

Feb. 14, 1980 [SE] Sweden ..... 8001144

[51] Int. Cl.[4] ..... F28F 19/00; F28F 21/08

[52] U.S. Cl. ..... 165/1; 122/20 B; 165/134.1; 237/55

[58] Field of Search ..... 165/134 R, 134 DP, 1, 165/134.1; 98/46; 237/2 B, 55; 122/20 B; 110/343

[56] References Cited

U.S. PATENT DOCUMENTS

| | | | |
|---|---|---|---|
| 1,565,304 | 12/1925 | Bell | 165/180 |
| 2,937,855 | 5/1960 | Hazen | 165/134 R |
| 2,942,855 | 6/1960 | Wellensiek | 165/134 R |
| 3,185,210 | 5/1965 | Kuhne et al. | 165/134 R |
| 4,141,702 | 2/1979 | de Vries | 55/94 |
| 4,149,453 | 4/1979 | Reed | 98/46 |
| 4,206,172 | 6/1980 | Sujdak | 110/343 X |
| 4,227,647 | 10/1980 | Eriksson | 237/2 B |

FOREIGN PATENT DOCUMENTS

| | | | |
|---|---|---|---|
| 34574 | 8/1981 | European Pat. Off. | 165/134 DP |
| 1438499 | 6/1976 | United Kingdom . | |

*Primary Examiner*—Sheldon J. Richter

*Attorney, Agent, or Firm*—Pasquale A. Razzano

[57] ABSTRACT

A method of preventing corrosion in boiler plant equipment when cooling flue gases originating from a combustion plant, such as flue gases containing sulphur oxide or organic acids, to a temperature beneath which sulfuric acid condenses (sulfuric acid dew point temperature) and a further temperature defined as an upper permitted wall-temperature of the stainless steel. The upper permitted wall temperature is with respect to the stainless steel material from which the walls are made and the prevailing partial pressure of water vapor present in the gases. This limiting temperature is specific to each stainless steel. The heat exchange is by means of a coolant, suitably water, located on the other, i.e. cold, side of the heat-exchanger wall; the coolant temperature is either at a set temperature or has a downwardly decreasing temperature gradient; condensation at dew point of acid is carefully controlled based on the respective temperature of the combustion gases, the specific upper permitted wall temperature, and the temperature on the hot side of heat transfer surface. An increase in the partial pressure of the water vapor increases the upper permitted wall temperature; this temperature limit can be increased by applying one of the following steps: supplying water or hydrogen-containing compounds to the combustion process, adding water to the gases, or cooling the gases at elevated pressures; a laminar flow region for the gases below the acid dew point "extends" the upper permitted wall temperature near the acid dew point temperature.

18 Claims, 10 Drawing Figures

TEMPERATURE REGIONS OR CORROSION STATES IN A HEAT EXCHANGER

ISO-CORROSION DIAGRAM FOR A STAINLESS STEEL IN THE $H_2O$-$H_2SO_4$-SYSTEM. THE STEEL IS ACTIVE ABOVE THE CURVES AND PASSIVE BELOW THE CURVES

SCHEMATIC HEAT EXCHANGER

METHOD OF PREVENTING CORROSION IN BOILER-PLANT EQUIPMENT

This application is a continuation of application Ser. No. 362,506, filed Mar. 26, 1982, now abandoned, which is a continuation-in-part of application Ser. No. 348,828, filed Feb. 16, 1982, now abandoned, which is a continuation of application Ser. No. 232,661, filed Feb. 9, 1981, now abandoned.

The invention relates to a method of preventing corrosion in boiler-plant equipment having heat transfer surfaces with a hot side and cold side, and when cooling acidic flue gases, i.e. combustion gases, originating from a combustion plant, to a temperature beneath the acid dew point of the gases, in a cooler having heat-exchange walls or heat transfer surfaces of stainless steel.

Flue gases generated when burning sulfur containing fuels, such as oil and coal, have present, inter alia, the sulphur oxides $SO_2$ and $SO_3$, and water vapor. When the gases are cooled to temperatures of about 400° C., the $SO_3$ and water vapor combine to form gaseous $H_2SO_4$. If the gases are cooled still further, i.e. below the dew point of sulfuric acid, liquid sulfuric acid is precipitated. The dew point of sulfuric acid normally lies within a temperature range of 80°-150° C. and is, among other things, dependent on the sulfur content of the fuel and the air/fuel ratio in the combustion process. This temperature will be designated herein as T2. The precipitate, i.e. condensate on the heat-exchanger wall, gives a highly concentrated sulfuric acid. This acid becomes more concentrated with higher temperatures. This liquid sulfuric acid creates an extremely corrosive environment in the gas cooler, gas ducts, and chimneys of the combustion plant where precipitation or condensation takes place.

If the temperature of the flue gas is so high that its content of hexavalent sulphur is present mainly in the form of $SO_3$, and $H_2SO_4$ has not been formed in gas form, then corrosion normally does not occur. This situation prevails mainly over 400° C. In this case there is no risk for sulphuric acid corrosion on heat exchanger surfaces irrespective of temperature of these surfaces.

If the temperature of the flue gas lies between 400° C. and the dew point of the sulphuric acid (i.e. 80° to 150° C.) and the temperatures of the heat exchanger surfaces are above the dew point of the sulphuric acid (i.e. 80° to 150° C.), then there is no risk for corrosion because no condensation takes place on these surfaces. On surfaces whose temperature is lower than sulphuric acid dew point, corrosion will easily occur. However, condensation of sulphuric acid will only occur within a thin boundary layer in the gas close to the surface. However, if the gas flow is laminar, the amount of the condensed sulphuric acid will be limited and so will the rate of corrosion. If, however, the flow is turbulent, then considerably higher amounts of sulphuric acid condense and the rate of corrosion increases accordingly.

If the flue gas temperature is lower than the sulphuric acid dew point, then sulphuric acid is condensed in larger amounts. To avoid unacceptable corrosion of stainless steel, the heat exchanger or heat transfer surface temperatures must be kept below the upper permitted wall temperatures which are described further herein, but which are designated as T1 herein.

Thus, in addition and according to another aspect of this invention, it is now possible to avoid corrosion on the heat exchanger surface made of stainless steel when the flue gas temperature is starting from 400° C. and above, and decreasing to the sulphuric acid dew point and the surface temperature of the heat exchanger on the hot side is below this dew point. In the region where the flue gas temperature is close to the acid dew point T2, it helps if the flue gas flow is kept laminar. In this region, the upper permitted wall temperature T1 is "extended" upwardly as a result of the laminar flow because the corrosion rate is acceptably low. Thus, relying on laminar flow in that region reduces the corrosion rate. The conditions for laminar and turbulent flue are well known. Laminar flow is reached at Reynolds numbers below around 2 300, provided sharp dimension changes, direction changes, and uneven surfaces are avoided.

It is extremely difficult to find a material which is capable of withstanding the corrosive attack of said combustion gases and, inter alia, tests carried out on various steels have shown that practically no steel or other conventional alloy can cope with the corrosive environment created when acid condenses from sulfur containing flue gases. Neither is there at present any established method of cooling the sulfur containing flue gases to a temperature beneath the so-called acid dew point before the gases are discharged to atmosphere through the chimneys or flue stacks of the plant.

When burning wood, the sulphur content of the flue gases is negligible. Instead, the gases contain such organic acids as formic acid and acetic acid. The method according to the invention is also effective in preventing corrosion by these acids. Consequently, although the invention relates particularly to the problems created by the condensation of sulphuric acid, it also pertains to those cases where the flue gases contain organic acids.

Hence, the object of the invention is to provide a method by which acidic gases, and in particular gases containing sulphur, are properly controlled and manipulated vis-a-vis the heat transfer surface (wall) temperature, the cooling medium temperature, and the flow regimes of the flue gases. When this method is employed, the gases can be cooled to temperatures beneath the acid dew point without the material (over which the gases pass) being attacked to an unacceptable extent.

Thus, the invention consists of a method of preventing corrosion in the heat exchanger, flues and chimney of a combustion plant when cooling flue gases, wherein the flue gases are passed to the heat exchanger at a temperature which lies above the acid dew point of the gases, and whereat the flue gases (also called combustion gases) are passed over the heat-transfer walls of the heat exchanger and cooled therewith to a temperature below the acid dew point of the gases, and the heat-exchanger walls are maintained at certain temperatures and these walls or surfaces are made of stainless steel. These surfaces are maintained at a temperature, which is lower than an upper permissible wall temperature (T1 temperature) determined by the point of intersection of (a) the boiling-point curve of the acid in the flue gases at the prevailing partial pressure of water vapor in the gases and (b) the curve which limits the corrosion-resistant region of the heat-exchanger walls, i.e. stainless steel, with respect of the same acid. The stainless steel heat transfer surfaces are maintained at the above temperature with the aid of a coolant located on the other side of the heat transfer surface (i.e. cold side of the walls). The exception or the "extension" of this temperature upwardly when relying upon laminar flow has been discussed previously and will be further discussed herein. The further "elevation" of the T1 temperature will also be explained with reference to the water vapor content in the flue gas.

The invention will now be described in more detail with reference to the accompanying drawings, wherein.

Figure 6:
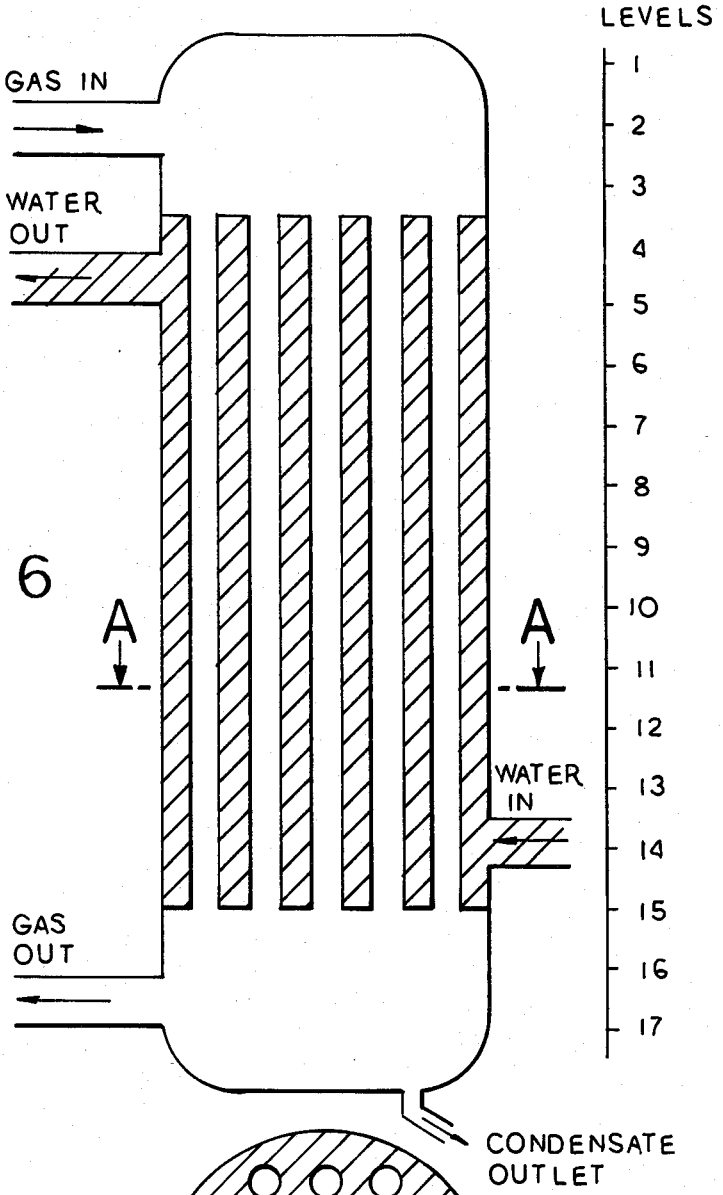
FIG. 6 is an illustration of a typical heat exchanger, in this instance, a tubular smoke (flue gas) tube heat exchanger.
Figure 6A:
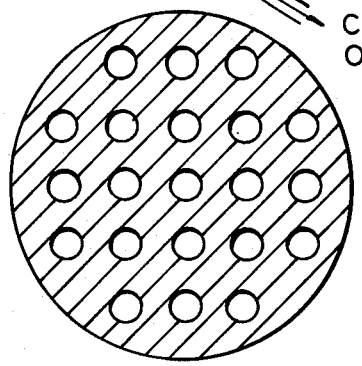
FIG. 6A is a cross-section of the heat exchanger of FIG. 6 along the line A—A thereof.
Figure 8:
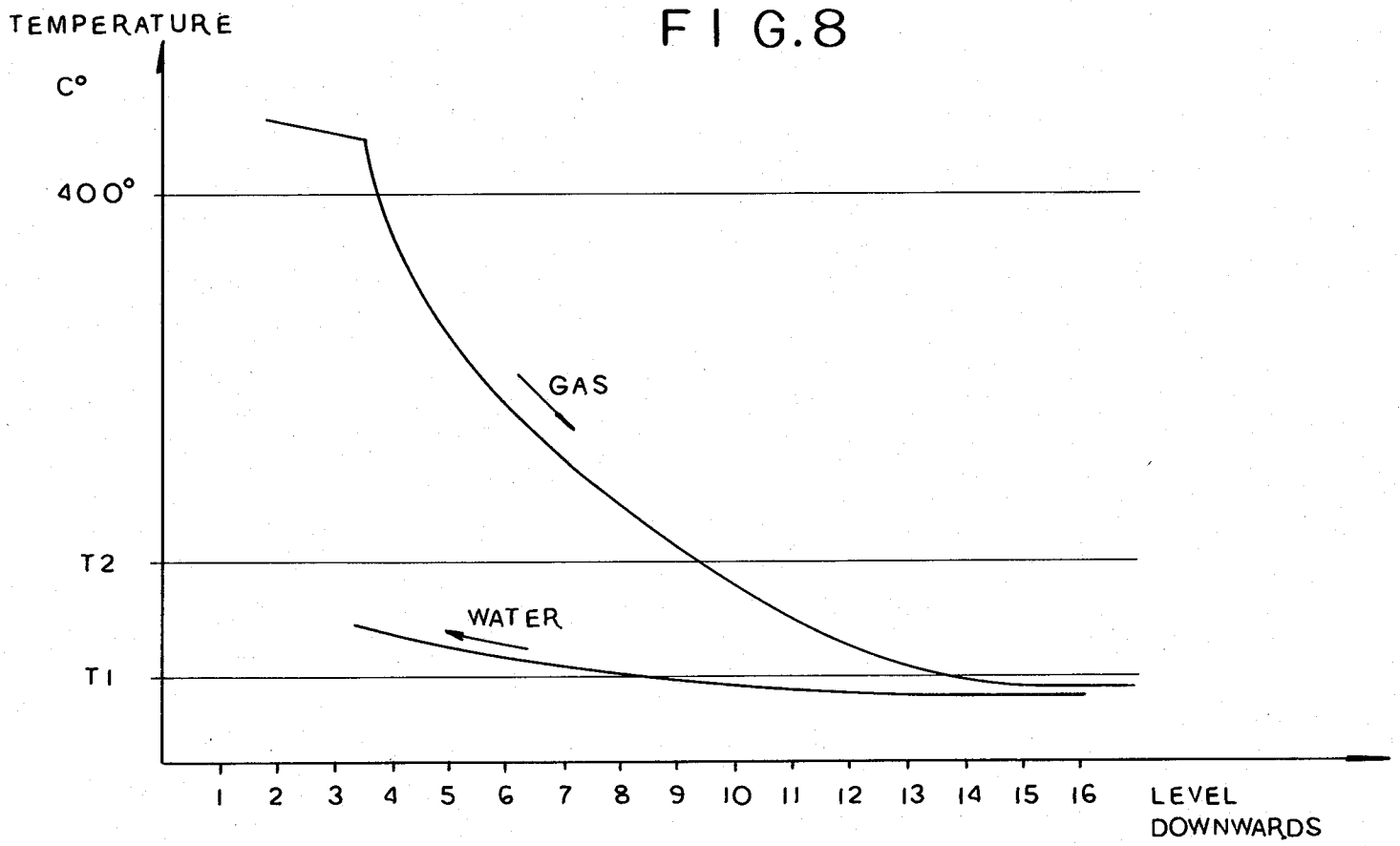
Figure 9:
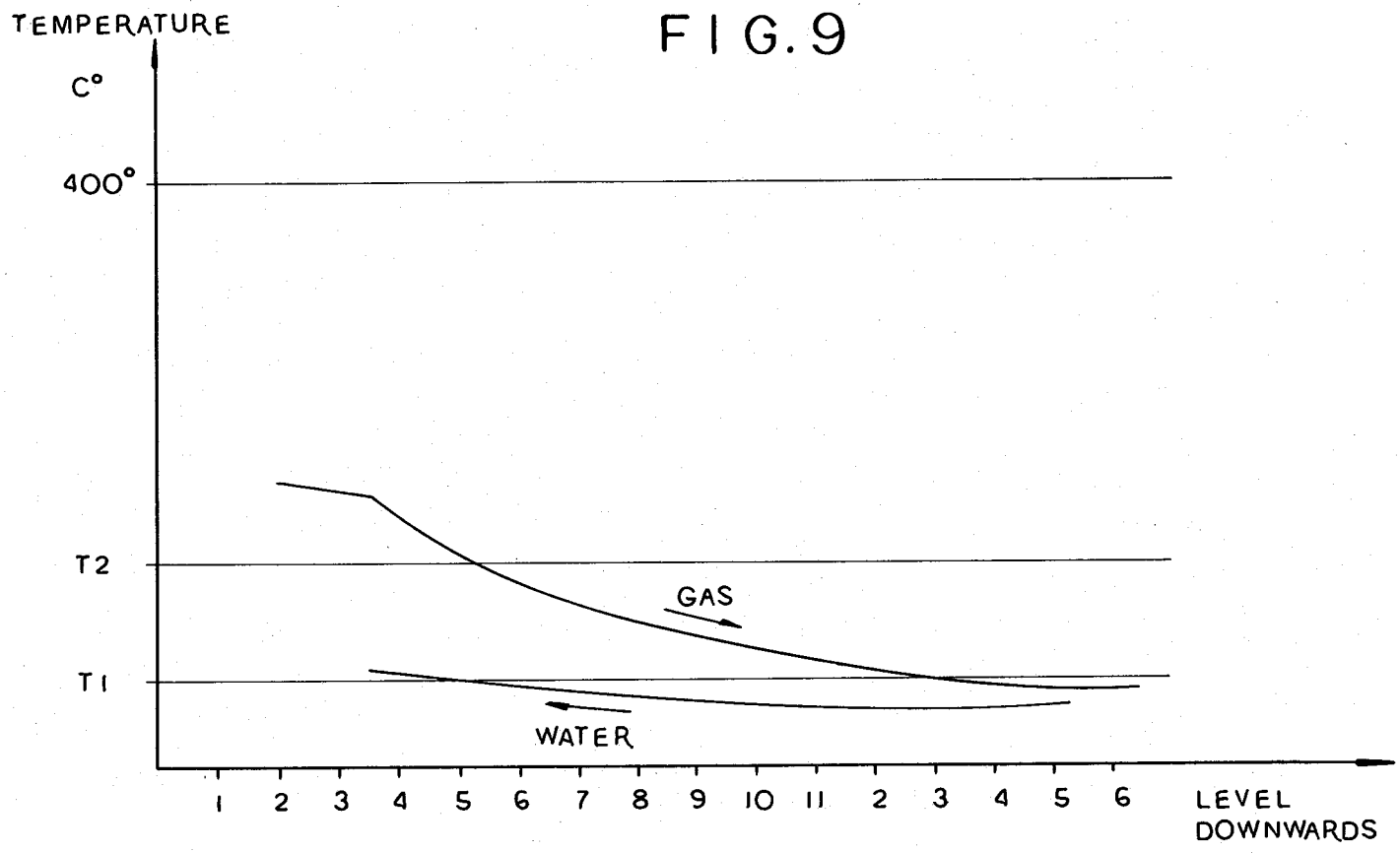

FIG. 8 is an illustration where the upper levels of the heat exchanger, e.g. of FIG. 6, are above the upper critical temperature T1, and this Figure illustrates that on those levels where the gas temperature is above but close to T2, laminar flow is preferred, and FIG. 9 is an illustration of a low incoming flue gas temperature such as in a heat exchanger of FIG. 6, where the incoming gas temperature is not far above T2 and the water or coolant temperature is slightly above and below T1.

Subsequent to being cooled to a temperature at which there is a risk of acid condensation (below 400° C. depending on the dew point and the wall temperature), the flue gases originating from said combustion process are passed from above downwardly over the hot side of the heat-exchanging walls of a cooler, whereat cooling is effected by means of a coolant, preferably water, located on the other side, i.e. cold side, of the heat-exchanging walls. The temperature of said coolant is substantially constant or decreasing from the initial contact with the hot combustion gases downwardly towards the lower part of the heat-exchanger. For purposes of this discussion, the very slight difference of the wall temperature between the hot side and the cold side will be ignored.

Liquid sulphuric acid will precipitate in the gas cooler on the heat-exchanger wall surfaces, e.g. of the type shown in FIG. 6, when the gas has been cooled to a temperature below 400° C. and when the temperature of the walls lies below the acid dew point temperature of the gases (T2 temperature). The composition of the condensed acid is dependent on the wall temperature at the location where condensation takes place, e.g. in accordance with the curve shown in FIG. 2 for the sulphuric acid content of the condensate. When the condensate forms a droplet, the droplet, according to the present invention, runs downwardly along the heat transfer surface of the heat-exchanger. If the temperature of the gas and/of the heat-exchanger surface increases downwardly, evaporation takes place, whereat the sulphuric acid in the droplet is enriched (because water is being evaporated) and its aggressiveness increases both as a result of an increase in temperature and in concentration. If, however, the droplet moves towards an area of still lower temperature, as is the case in accordance with the invention, the temperature and sulphuric acid content of the droplet will decrease, causing the aggressiveness of said droplet to be quickly reduced.

Figure 3:
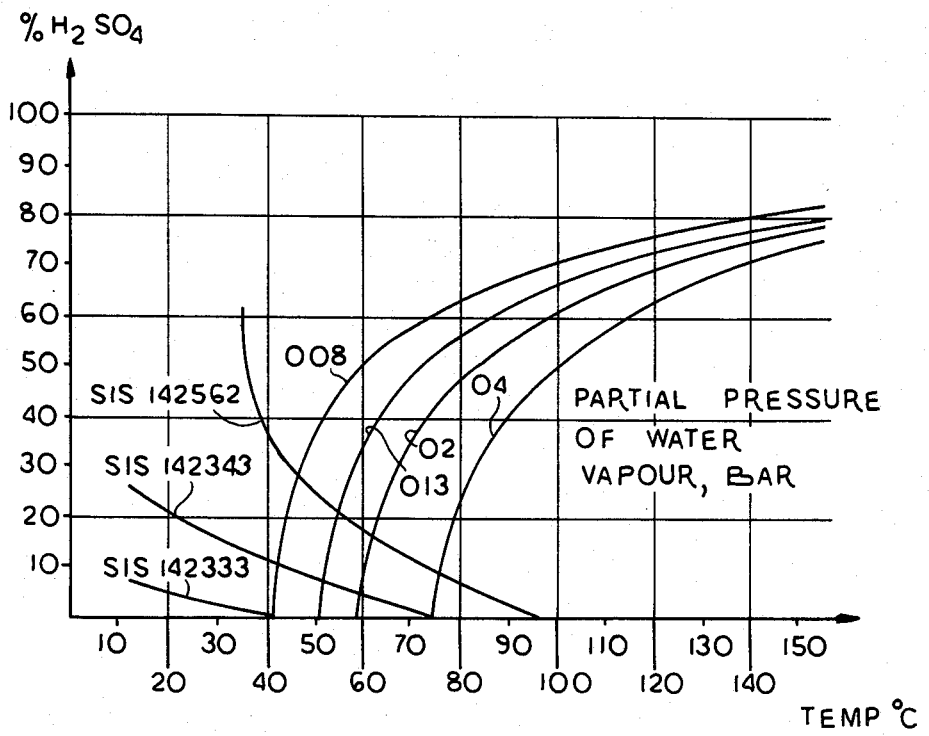
FIG. 3 shows a permitted upper wall temperature T1 in the cooler for different partial pressures of water vapor and wall materials in the cooler on the hot side thereof; T1 is obtained as the temperature of the intersection of partial pressure and iso-corrosion curves.

The temperature of the coolant in the heat-exchanger must not exceed a value dependent on the partial pressure of water vapor in the flue gas and on the material from which the walls of the heat-exchanger are made, as shown in FIG. 3. In this figure there are shown the upper limit lines for the fields of use of various, different steels in an environment comprising a mixture of water and sulphuric acid and the sulphuric acid content of condensate formed at varying wall tempertures, and the partial pressure of the water vapor. The point at which the limiting line with respect of a steel and the line representing the sulphuric acid content of the condensate intersects, that point denotes the maximum permitted wall temperature (T1 temperature) in those parts of the heat-exchanger where acid can condense out. Since the temperature difference between the temperature of the coolant (cooling water) and the temperature of the walls is small, the same conditions, i.e. T1 temperature, are represented by the water temperature.

In order to understand corrosion, especially in flue gases when stainless steel is employed, one must also understand the two natures of stainless steel. First, stainless steel can be defined, for purposes of this invention, as steel containing more than about 8% of chromium, preferably more than about 12% chromium, by weight. Stainless steels get their corrosion resistance by the formation of a chromium oxide layer on the steel surface. At lower chromium content, e.g. 6%, the surface covering chromium oxide layer does not form a continuous layer or film. This oxide layer forms very rapidly in oxidizing, neutral, and slightly reducing systems. The steel is said to be in its passive state. The rate of corrosion in the passive state is extremely low even in comparatively strong acids. In strongly reducing acids, however, the oxide layer is eliminated. The steel is then in its active state. In the active state, stainless steel corrodes as fast as mild steel.

Figure 5:
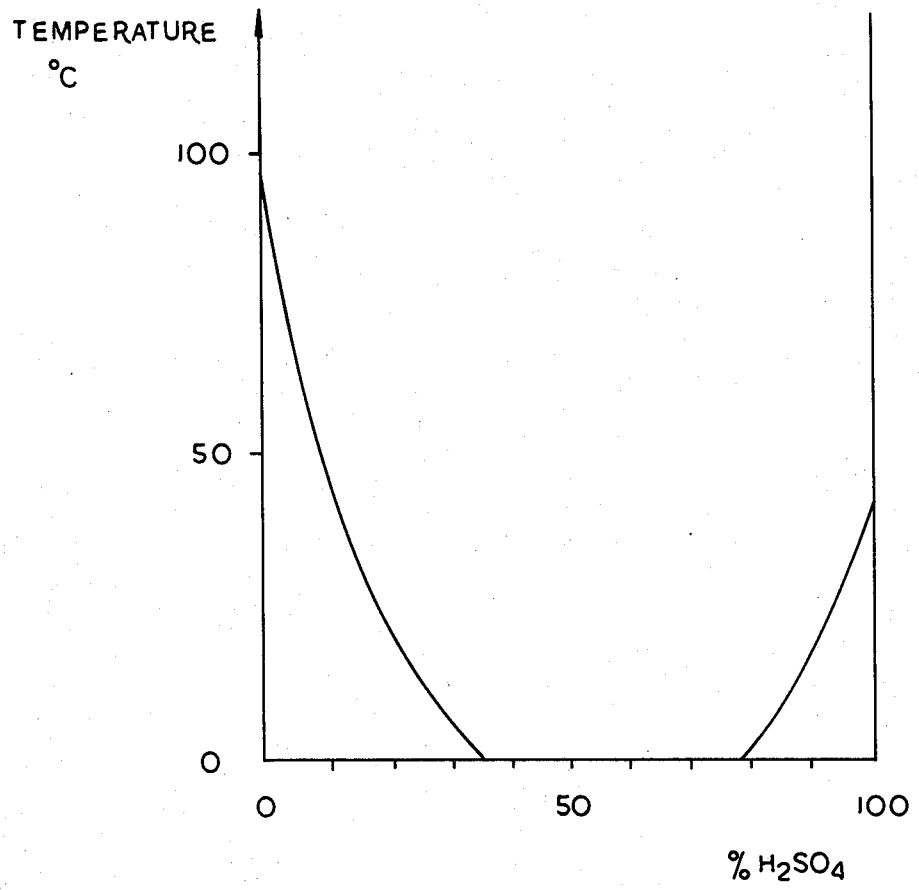
FIG. 5 is an iso-corrosion diagram for a stainless steel.

In a phase diagram FIG. 5, e.g. water-sulphuric acid, it is shown that under certain conditions a certain stainless steel is passive or active. The curve in this figure shows the boundary between active and passive conditions for a steel. These are called the curves which limit the corrosion-resistant region of certain steels. Sometimes these curves are called iso-corrosion curves when these are determined at the conditions where a certain low corrosion rate is obtained, e.g. 0.1 mm/year. These curves can be found in standard textbooks of corrosion for the various standard stainless steels.

The other curves in FIG. 3 herein show the concentration of sulphuric acid (ordinate) of a condensate which is found on a heat exchanger surface of a certain temperature (abscissa) and at a certain partial pressure of water vapor. If the diagram is turned 90°, it can be seen that these are simply the boiling-point curves for the water-sulfuric acid system at different pressures.

Now, if one curve gives the sulphuric acid concentration as function of temperature and the other curve shows the limit of resistance for a steel, the intersection gives the maximum acceptable or tolerable temperature, i.e. the T1 temperature.

Figure 4:
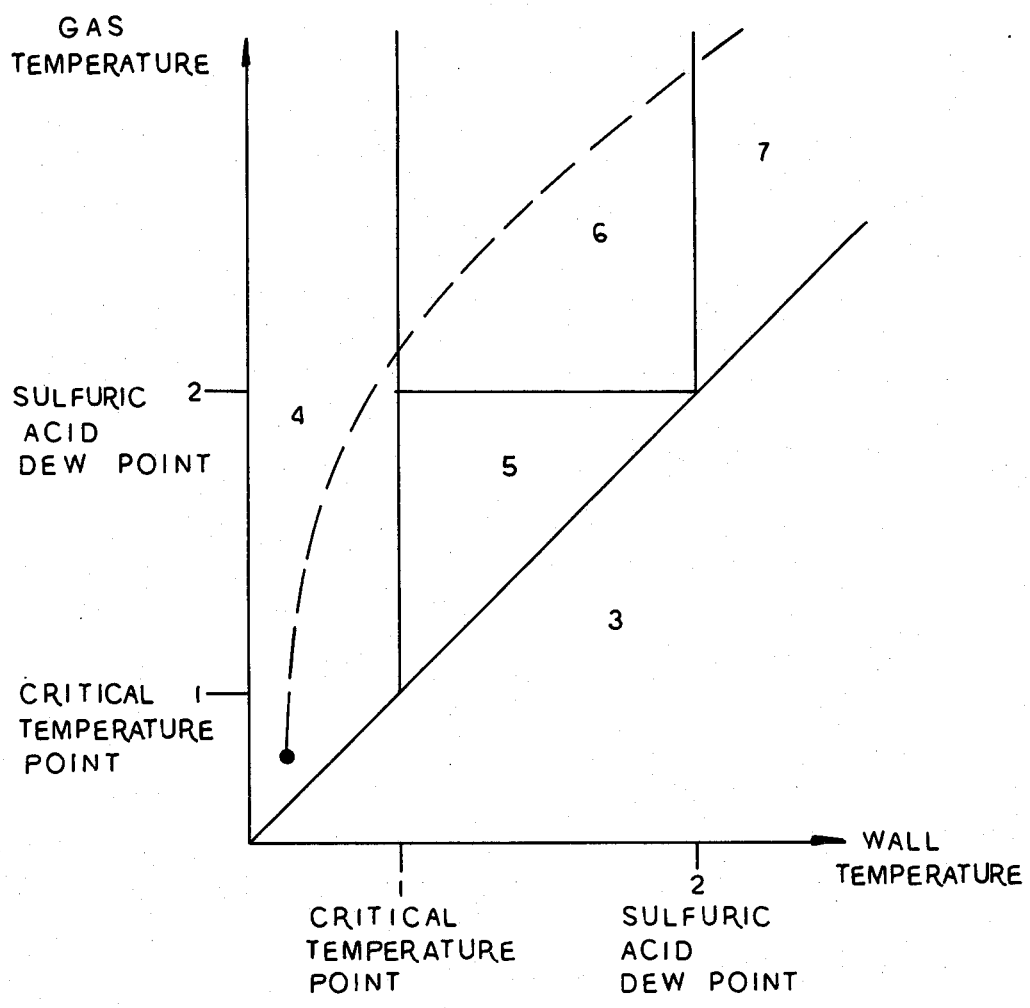
FIG. 4 is an illustration of temperature states and/or corrosion states in a heat exchanger.

FIG. 4 explains more fully and prescribes the manner in which to cool the gas in a heat exchanger having stainless steel walls. Thus, in FIG. 4, a diagram illustrates temperature states in a gas cooler (heat exchanger). The ordinate gives the gas temperature and the abscissa gives the heat exchanger surface or wall temperature. The dashed line shows the temperature of the gas as it flows through the heat exchanger. The upper critical temperature points (the T1 temperatures), according to this application, are designated as (1), and the sulphuric acid dew points (the T2 temperatures) are designated as (2) and are marked on both axes. These correspond to the previously used T1 and T2 temperature points. The figure is divided in five fields. In field 3 the wall is hotter than the gas and this situation does not occur in a gas cooler. In field 4 the wall temperature is lower than the upper critical temperature and thus corrosion is controlled in this area. In field 5 the wall temperature and the gas temperature are above the upper critical temperature (T1 temperature) and below the sulphuric acid dew point (T2 temperature). Here extensive condensation of sulphuric acid will occur and all steel heat exchangers will corrode rapidly. In field 6 only the gas temperature is above the sulphuric acid dew point (the T2 temperature), but the wall temperature is still in "the forbidden range", i.e. above T1 temperature. Corrosion will be more severe the closer the temperatures of the wall and gas are to the lower left corner of the field labeled 6. However, condensation of sulphuric acid occurs only in a very thin boundary layer of the gas and the condensed amounts can be kept at such low levels that acceptable lifetimes of the heat exchangers are obtained. Hence, when near the left corner of the field labeled 6, laminar flow may be employed to "extend" the T1 temperature upwardly. In other words, acceptable corrosion rates are observed. In field 7 both gas and wall are above the sulphuric acid dew point and the situation is completely safe. At cooling, the area 5 must be avoided. This can be done by keeping the cooled gas temperature relationship with respect to the wall temperature which follows the dotted line in FIG. 4. As can be seen, the line follows the T1 and T2 relationships disclosed further herein, i.e. when the gas temperature is in the dangerous range (between T1 and T2), the wall temperature must be below T1 .

If cooling of the flue gases is continued to an extent such that the temperature falls beneath the dew point of the water vapor, water is condensed so as to greatly dilute the sulphuric acid, wherewith the corrosive attack is much milder than at temperatures above the dew point of the water vapor.

Figure 7:
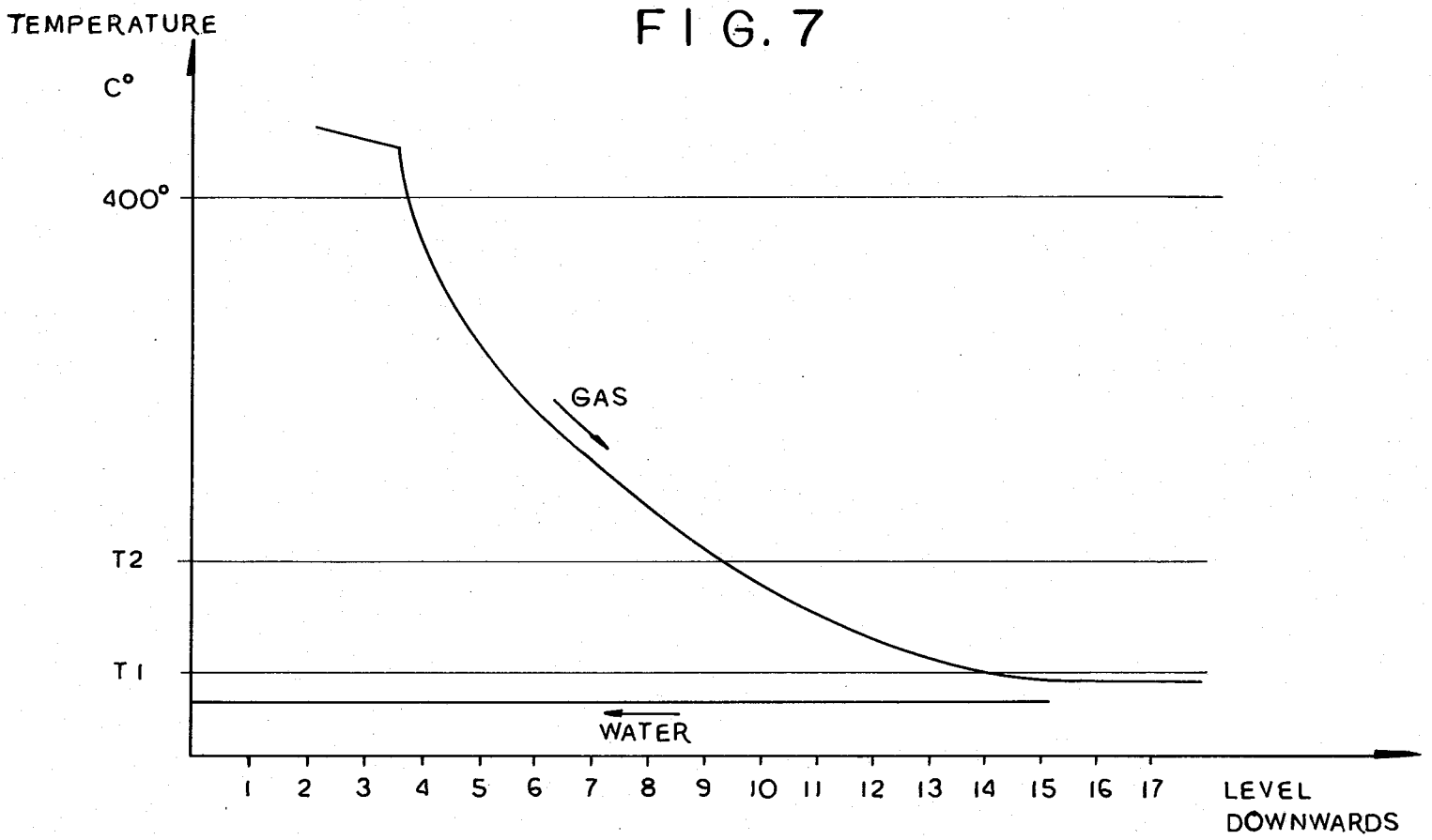
FIG. 7 is an illustration of an extremely safe operation of the heat exchanger, e.g. of FIG. 6.

Normally the dew point of water vapor in flue gases originating from oil-fired boilers lies within a temperature range of 40°–60° C., but more typically 40°–50° C. At a temperature slightly below the dew point, the sulfuric-acid content of the condensate is of the order of magnitude in the tenths of percents, 0.1 to 0.5%, while at a temperature slightly above said dew point said sulphuric acid content is of the order 20 to 50%. Consequently, in accordance with a particularly preferred embodiment of the invention, the temperature of water on the cold side of the heat-exchanger, i.e. in the cooler, is maintained below the water dew point of the flue gases, i.e. such as illustrated in FIG. 7 herein. This enables the cooler to be constructed from a relatively simple stainless steel, e.g. a steel of the type SIS 142333 (which corresponds to AISI 304).

Downstream of the heat exchanger of a boiler there is normally found uncooled flue ducts and an uncooled stack or chimney. Although no intentional cooling is arranged in these structural elements, condensate is also formed on the surfaces of said elements if the gases are cooled in the cooler to a temperature which lies below or in the vicinity of the acid dew point (the T2 temperature). Consequently, in accordance with a further embodiment of the invention, the flue gases are cooled to an extent that the temperature of said gases lies below the upper critical temperature given above (i.e. the gas temperature is below the T1 temperature). By cooling the gases in this manner, the aforementioned ducts and smoke stacks or chimneys can be constructed from the same material without risk of corrosion, which material can be determined from FIG. 3, or if the temperature is below the dew point of water from the steel SIS 142333 (which corresponds to AISI 304).

Figure 1:
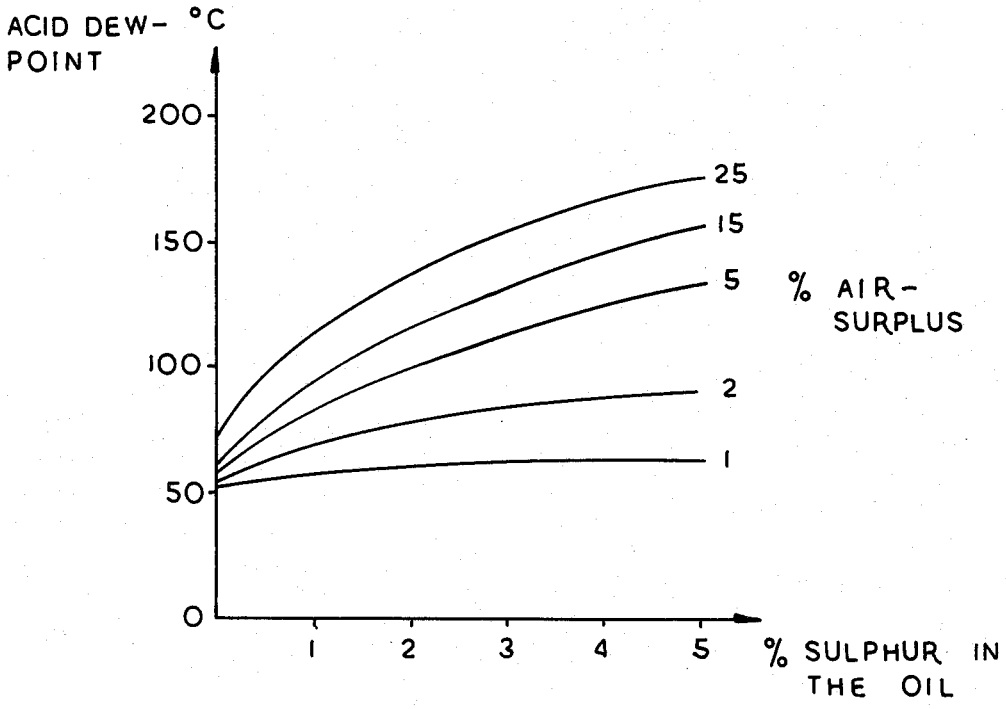
FIG. 1 shows the sulphuric-acid dew point as a function of the sulphur content of oil and the air surplus during the combustion process.
Figure 2:
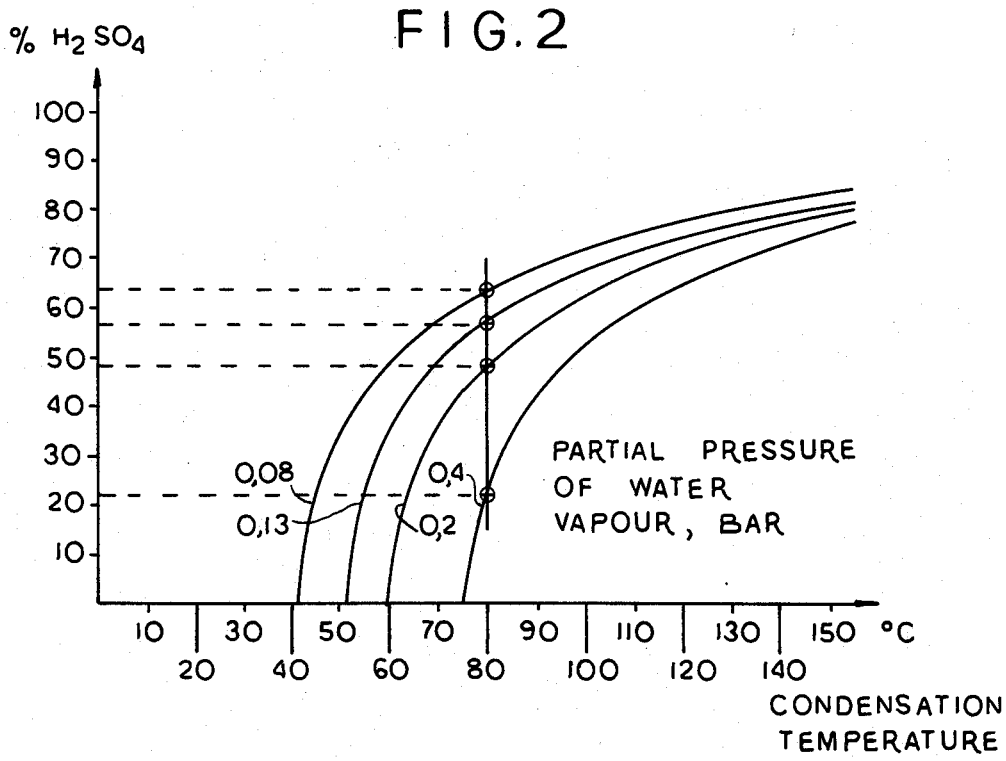
FIG. 2 shows the sulphuric acid content in the flue-gas condensate as a function of condensation temperature and the partial pressure of the water vapor in the flue gas.

The partial pressure of water vapor in the flue gases is extremely influential on the corrosion conditions presented by acid condensation. This is shown in FIG. 2. In the case of one and the same condensation temperature (which is equal to the temperature of the heat-exchanger walls in the gas cooler), the sulfuric acid content of the condensate decreases with an increasing partial pressure of water vapor. As an example, there has been chosen in FIG. 2 a condensation temperature of 80° C. (the straight, vertical line). The following sulfuric acid contents are then obtained in the condensate:

| Partial pressure of water vapor | Sulfuric acid content in the condensate |
|---|---|
| 0.08 bar | 63% |
| 0.13 bar | 56% |
| 0.20 bar | 48% |
| 0.40 bar | 22% |

Another consequence of water vapor partial pressure can be seen from FIG. 3. At the same partial pressures as in the tabulated example above, different intersections with the iso-corrosion curve are obtained. As an example, steel SIS 142343 (same as AISI 316) allows the following maximum acceptable wall temperatures, i.e.:

| Partial pressure of water vapor | Maximum permissible wall temperature of Steel SIS 142343 |
|---|---|
| 0.08 bar | 42° C. |
| 0.13 bar | 55° C. |
| 0.20 bar | 60° C. |
| 0.40 bar | 75° C. |

One embodiment of the invention therefore relates to a method of increasing the partial pressure of water vapor. This can be effected either by supplying water to the combustion process, or by supplying hydrogen-containing compounds which form water during said process, or by increasing the pressure of the flue gases during the condensation process. This is the second exception previously alluded to above, and this increase of partial pressure of water vapor illustrates the "elevation" or upwardly increased T1 temperature for the same stainless steel, or conversely the employment of a less expensive stainless steel, e.g. by reference to FIG. 3.

As shown schematically in FIG. 6, a typical flue gas heat exchanger, such as a tubular smoke tube heat exchanger, has a number of passages for downwardly flowing gas which are surrounded by upwardly flowing water. FIG. 6. A shows a cross section through A—A of FIG. 6. The various temperature levels are represented on a scale placed on the right hand side of the depicted heat exchanger.

In FIGS. 7 to 9, various temperature distributions have been shown at the various levels by reference to FIG. 6 heat-exchanger. In accordance with the previous discussion and especially with reference to FIG. 4, these temperature distribution curves illustrate the previous T1 and T2 relationships.

For example, FIG. 7 shows a case with extreme margin of safety towards corrosion. The gases enter the heat exchanger above 400° C. On all levels where sulfuric acid is present in gaseous or liquid state, the heat exchanger surfaces are below the upper critical temperature (the T1 temperature).

Next, FIG. 8 shows a case where the upper levels (from level 8 upwardly) of the heat exchanger surfaces are above the upper critical temperature (T1). It is vital then that the gas temperature on those levels lies above the sulfuric acid dew point (T2). On those levels where the gas temperature is above but close to T2 and the surface temperature is above T1, laminar flow is preferred (levels 6 to 8). At the level where the gas temperature reaches T2 and below that level, the surface temperature must lie below T1.

Finally, FIG. 9 illustrates a case with a low incoming gas temperature not far above T2, and the water is heated so high that the surface temperature reaches slightly above T1. Here again, laminar flow is vital above the level where the surface temperature reaches T1. Below the level where the gas temperature is cooled below T2, the surface temperature again must be lower than T1.

Of course, each particular steel has its particular T1 temperature. Depending on the cooler temperature during the operation, these temperatures are selected from the available curves for the various stainless steels (such as shown in FIG. 5, and are further considered in light of the water concentration, i.e. partial pressure, in the flue gas).

Thus, for any given stainless steel, its acceptable corrosion rate will be at a temperature below T1 if turbulent flow occurs, and that T1 temperature will be as a function of the water and sulfuric acid content of the flue gas at the condensate dew point (T2 temperature), as shown by the figures herein. Consequently, it helps to maintain a higher margin of safety when operating at a high water vapor content in the flue gas for given sulfuric acid cotent at the dew point. Near the T2 temperature point (but still above it), a necessary margin of safety is obtained for the same water-sulfuric acid content in the flue gas (for the same steel) if the flow of the flue gas is kept laminar.

It is noted that when heat is extracted from the flue gas in the near T2 temperature region and below it and the T1 temperature region and even lower, such as when the flue gas is below T1 temperature, the total heat recovery is approximately 91+%, whereas with the prior art, because of the lack of understanding of the corrosion problems and how to control these in a stainless steel heat exchanger, the best that could be achieved was 85% heat extraction. When one considers this tremendous amount of heat loss, such as from heating units, one can appreciate the savings that are realized when practicing the present invention.

In order to investigate what effect can be achieved with a cooler constructed in accordance with the invention coupled between the hearth and chimney or smoke stack of a boiler installation, tests have been carried out in such an installation which was oil-fired.

The cooler was made of steel of the type SIS 142333 (which corresponds to AISI 304). The flue gases were cooled in the cooler to a temperature below 50° C. The temperature of the heat-exchanger walls of the cooler were at most 40° C. in the lower part of the cooler and at most 60° C. in the upper part of said cooler. The temperature of the gas in the upper part of the cooler was in excess of 400° C., and hence no sulphuric acid condensate was precipitated on wall surfaces having a temperature higher than 50° C. A condensate was formed having a pH of 2.2. The amount of condensate formed was about 0.5 liter per liter of oil consumed, which shows that a significant part of the water content of the gases had condensed.

Careful investigation of the flue gas ducts showed that the upper regions of the ducts, where the temperature was not below the water dew point of the gases, were subjected to corrosion, said material of said ducts being the aforementioned steel AISI 304. On the other hand, no corrosion was visible on ducts made from the steel AISI 316. In the lower part of the flue-gas ducts where the temperature was lower than the water dew point of the flue gases and where a large quantity of diluted sulphuric acid had been precipitated, no corrosion could be seen on either the ducts constructed from the steel AISI 304 or the steel AISI 316.

In the case of flue gases containing other acids, such as acetic acid and formic acid, the same rules apply with respect to condensation and corrosion. Those limits which apply to sulphuric acid are, in the majority of cases, sufficient to solve the corrosion problems presented by the flue gases which contain other acid.

In view of the above, to prevent corrosion when cooling flue gases in a cooler for flue gases, the flue gases are conducted over heat exchanger surfaces and are cooled below the sulfuric acid dew point of the flue gas. The flue gas is introduced in the heat exchanger at a temperature of above 400° C. Typically, the heat exchanger surfaces are made of stainless steel and are held below the certain maximum allowable temperature as explained above. In those parts of the cooling system, an embodiment herein illustrates that corrosion is eliminated if the flue gas temperature is between 400° C. and the sulphuric acid dew point and in the region near, but above T2, the water temperature is above the upper permissible T1 temperature. Accordingly, the rate of the gas flow and the conduit geometry is chosen in a manner such that turbulent flow is avoided. The flue gas is introduced into the cooler at a temperature above the flue gas sulfuric acid dew point (T2 temperature). In those parts of the heat exchanger where the flue gas temperature is between 400° C. and the flue gas sulfuric acid dew point and, more importantly, the heat exchanger hot side surface temperature is between this dew point and the upper allowable temperature (according to the earlier explanation), the gas flow is kept substantially laminar.

Thus, the heat exchanger surfaces in the lower part of the heat exchanger where condensation of sulfuric acid occurs (T2 temperature) are kept below the upper allowable surface temperature (T1 temperature), but the surface in the upper part is allowed to raise above the upper allowable temperature (T1 temperature). As long as the T2 line has not been crossed by the gas and as long as the flow is laminar before the T2 line is crossed, if flow is laminar corrosion is at an acceptable level. The flue gases are still introduced at such a high temperature that the gas temperature in the upper, hot part of the heat exchanger is above 400° C.

Moreover, the surface in the lower part of the heat exchanger after the gases cross the T2 line is kept at a temperature below the upper allowable temperature, the surface in the upper part is allowed to raise above the upper allowable temperature, and the flue gases are introduced at such a high temperature that the gas temperature in the upper, hot part of the heat exchanger is above the flue gas sulphuric acid dew point.

Accordingly and by this method, if the flow of the flue gas in the upper, hot part of the heat exchanger above the T2 cross-over point is kept laminar, then the corrosion between the two above discussed temperature points or levels in a heat exchanger is minimized.

The above discussion presupposes that the heat transfer medium can be maintained at a constant temperature which is such that the upper permissible temperature is not exceeded (when T2 cross-over point is reached), or with a temperature gradient correspondingly decreasing with the hot flue gases as these are being cooled. Water as a coolant in heat exchangers is especially suitable, as it maintains a fairly definite temperature or a temperature gradient without substantial intermixing. For this reason, the flue gas flow, when water temperature has a gradient, is downwardly and towards the cooler temperature in the heat exchanger.

What is claimed is:

1. A method for preventing corrosion in a combustion plant wherein heat is abstracted from the combustion gases, i.e., flue gases, including from said flue gases at temperatures below an acid dew point for said flue gases, said heat being abstracted in a heat exchanger zone, having a hot side of a heat transfer surface of stainless steel, including preventing corrosion of said heat transfer surfaces as well as ducts, flues and chimney parts thereof, said corrosion being occasioned by combustion by-products including sulfur trioxide, sulfur dioxide, sulfuric acid and the like, and other aggressive corrodents formed during combustion, said method comprising:

(a) passing combustion products, such as said flue gases, from a combustion zone to said heat exchanger zone where said heat transfer surfaces are of stainless steel and are exposed to said combustion products;

(b) maintaining the heat transfer surfaces exposed on the opposite side of said combustion gases to a cooling medium which is either (i) at a constant temperature or (ii) at a temperature difference which, relative to a temperature for said combustion gases, is between an initial combustion gases temperature which contacts the cooling medium and an initially entering cooling medium temperature, wherein said cooling medium temperature is decreasing in a direction of flow of said combustion gases as the combustion gases decrease in temperature, said temperature difference between said combustion gases and said cooling medium approaching a smaller difference or approaching a substantially relatively constant temperature difference between said combustion gases exiting said heat exchanger zone and said cooling medium entering said heat exchanger zone with the cooling medium temperature being below said temperature for said combustion gases;

(c) condensing on the heat transfer surface exposed to said combustion products corrosively aggressive condensates, including sulfuric acid and the like, at a temperature below the acid dew point of said combustion gases;

(d) maintaining the hot side of said heat transfer surface, by cooling, at a temperature below an upper permitted wall temperature, and (e) wherein the heat transfer surfaces are arranged vertically with the combustion gases passing vertically downwardly on one side of said heat exchanger vertical surfaces and the cooling medium passing on the opposite side of said heat exchanger surfaces.

2. The process as defined in claim 1, wherein said hot side of said heat transfer surface where condensate of steps (c) and (d) form are exposed at all times at a temperature below an initial sulfuric acid dew point of said combustion gases and below the upper permitted wall temperature.

3. The process as defined in claim 1 wherein the flue gases are being discharged with said condensates at a temperature which is below the acid dew point temperature for said combustion gases and below the upper permissible wall temperature through said combustion plant, including discharging the combustion gases through a chimney, a duct, a flue and/or other discharge zones thereof, and wherein the same are made of a stainless steel.

4. The method as defined in claim 1 wherein the hot combustion products are from a combustion zone and are at a temperature of about 400° C. when these combustion products first contact the heat transfer surfaces.

5. The method as defined in claim 1 wherein the hot side of said heat transfer surface, whereupon said corrosively aggressive condensates flow, including said sulfuric acid-water condensates, are at a temperature below 60° C.

6. The method as defined in claim 5 wherein the temperature is below 50° C.

7. The method as defined in claim 1 wherein the combustion gases are discharged through said chimney or duct at a temperature below an upper permitted temperature limits for a stainless steel of which said chimney or duct zones are made.

8. The process as defined in claim 1 wherein the flue gas is augmented with water vapor which is present in said combustion gases before a point where said condensation occurs in step (c).

9. The method as defined in claim 8 wherein a partial pressure of water in said flue gas is increased by supplying water or hydrogen-containing compounds to the combustion process.

10. The method as defined in claim 1 wherein the heat transfer surface is of AISI 304 steel, which corresponds to SIS 142333 steel.

11. The method as defined in claim 1 wherein the chimney or duct zones are of AISI 304 steel, which corresponds to SIS 142333 steel.

12. The method as defined in claim 1 wherein the chimney or duct zones are of AISI 316 steel, which corresponds to SIS 142343 steel.

13. The method as defined in claim 1 wherein the heat transfer surfaces are of an AISI 316 steel, which corresponds to SIS 142343 steel.

14. The method as defined in claim 1 wherein a partial pressure of water vapor, in order to increase the dew point temperature, is increased by cooling said combustion gases at elevated pressures.

15. The method according to claim 1 wherein in the temperature zones where the temperature for said combustion gases on the hot side of said heat transfer surface starts from above 400° C. and between above the dew point of an acid condensate, the flue gas flow is laminar.

16. The method as defined in claim 1 wherein the region in which the wall temperature is restricted to below an upper permitted temperature is extended by laminar flow of the gas before condensation of condensates occurs.

17. The method as defined in claim 1 wherein a coolant temperature increases upwardly towards an upper zone of a heat exchanger zone.

18. A method for preventing corrosion in a combustion plant wherein heat is abstracted from the combustion gases, i.e., flue gases, including from said flue gases at temperatures below an acid dew point for said flue gases, said heat being abstracted in a heat exchanger zone, having a hot side of a heat transfer surface of stainless steel, including preventing corrosion of said heat transfer surfaces as well as ducts, flues and chimney parts thereof, said corrosion being occasioned by combustion by-products including sulfur trioxide, sulfur dioxide, sulfuric acid and the like, and other aggressive corrodents formed during combustion, said method comprising:

(a) passing downwardly combustion products, such as said flue gases, from a combustion zone to said heat exchanger zone where said heat transfer surfaces are of stainless steel and are exposed to said combustion products;

(b) maintaining the heat transfer surfaces exposed on the opposite side of said combustion gases to a cooling medium which is either (i) at a constant temperature or (ii) at a temperature difference which, relative to a temperature for said combustion gases, is between an initial combustion gases temperature which contacts the cooling medium and an initially entering cooling medium temperature, wherein said cooling medium temperature is decreasing in a downwardly direction of flow of said combustion gases as the combustion gases decrease in temperature, said temperature difference between said combustion gases and said cooling medium approaching a smaller difference or approaching a substantially relatively constant temperature difference between said combustion gases exiting said heat exchanger zone and said cooling medium entering said heat exchanger zone with the cooling medium temperature being below said temperature for said combustion gases;

(c) condensing on the heat transfer surface exposed to said combustion products corrosively aggressive condensates, including sulfuric acid and the like, at a temperature below the acid dew point of said combustion gases, wherein corrosively aggressive condensates are caused to flow downwardly along said heat transfer surfaces of said hot side of said heat transfer surface, and (d) maintaining the hot side of said heat transfer surface, by cooling, at a temperature below an upper permitted wall temperature.

* * * * *